US007497208B2

(12) United States Patent
Satoh et al.

(10) Patent No.: US 7,497,208 B2
(45) Date of Patent: Mar. 3, 2009

(54) FUEL SUPPLY DEVICE HAVING SHIELDED IN-TANK FUEL PUMP FOR USE IN AUTOMOTIVE VEHICLE

(75) Inventors: Taketoshi Satoh, Kariya (JP); Manabu Nomura, Toyota (JP)

(73) Assignee: DENSO CORPORATION, Kariya (JP)

( * ) Notice: Subject to any disclaimer, the term of this patent is extended or adjusted under 35 U.S.C. 154(b) by 7 days.

(21) Appl. No.: 11/790,112

(22) Filed: Apr. 24, 2007

(65) Prior Publication Data

US 2008/0011276 A1 Jan. 17, 2008

(30) Foreign Application Priority Data

Jul. 11, 2006 (JP) ..... 2006-190527

(51) Int. Cl.
*F02M 37/04* (2006.01)
*F02M 37/08* (2006.01)

(52) U.S. Cl. ..... 123/509; 417/423.14; 310/71

(58) Field of Classification Search ..... 123/509, 123/497, 447, 446; 417/423.14, 423.3, 410.1; 137/565.16; 310/71, 68 R
See application file for complete search history.

(56) References Cited

U.S. PATENT DOCUMENTS 3,726,310 A * 4/1973 Coscia ..... 137/576
4,651,701 A * 3/1987 Weaver ..... 123/509
5,231,967 A * 8/1993 Baltz et al. ..... 123/497
5,613,844 A * 3/1997 Tuckey et al. ..... 417/366
6,474,374 B1 * 11/2002 Kleppner ..... 141/198
6,530,757 B1 3/2003 Soyer et al.
6,541,883 B2 4/2003 Uffelman
2005/0100461 A1 5/2005 Izutani et al.
2005/0284448 A1 * 12/2005 Forgue et al. ..... 123/497
2006/0213486 A1 * 9/2006 Powell et al. ..... 123/509

FOREIGN PATENT DOCUMENTS

JP U-2-145655 12/1990
JP A-9-32674 2/1997

* cited by examiner

*Primary Examiner*—Mahmoud Gimie
(74) *Attorney, Agent, or Firm*—Posz Law Group, PLC

(57) ABSTRACT

A fuel supply device mounted on an automotive vehicle includes a fuel pump and a sub-tank containing the fuel pump therein. The sub-tank and the fuel pump are submerged in fuel contained in a fuel tank. Operation of the fuel pump is controlled in a switching manner thereby to supply the fuel contained in the fuel tank to an internal combustion engine. When the fuel tank is made of a resin material, electromagnetic noises generated in the switching operation of the fuel pump are emitted from the fuel pump through the fuel tank, interfering with radio waves received by a receiver mounted on an automotive vehicle. To shield such noises, the fuel pump is disposed in the sub-tank that is made of a metallic material and grounded to a body of the vehicle. In this manner, the noises from the fuel pump are surely intercepted.

6 Claims, 4 Drawing Sheets

FUEL SUPPLY DEVICE HAVING SHIELDED IN-TANK FUEL PUMP FOR USE IN AUTOMOTIVE VEHICLE

CROSS-REFERENCE TO RELATED APPLICATION

This application is based upon and claims benefit of priority of Japanese Patent Application No. 2006-190527 filed on Jul. 11, 2006, the content of which is incorporated herein by reference.

BACKGROUND OF THE INVENTION

1. Field of the Invention

The present invention relates to a fuel supply device for supplying fuel contained in a fuel tank of an automotive vehicle to an internal combustion engine.

2. Description of Related Art

An example of a fuel supply device, in which electromagnetic noises generated in a pump control circuit are suppressed, is disclosed in JP-A-2005-155602. In this device, the pump control circuit is mounted on a pump module cover closing an upper opening of a fuel tank thereby to place the pump control circuit that generates radio noises outside a passenger compartment and to shorten a load line connecting the pump control circuit to an in-tank fuel pump. In this manner, radio noises are suppressed without using a noise filter (composed of a coil and a capacitor) inserted in the load line. Switching noises emitted from the in-tank fuel pump itself are shielded by a fuel tank made by a metallic material.

However, it is a recent trend that a material of the fuel tank is changed from a metallic material to a resin material. In this case, the switching noises emitted from the in-tank fuel pump pass through the fuel tank without being shielded by the fuel tank. The switching noises emitted from the fuel pump reach the ground, and the noises are reflected on the ground and picked up by a radio antenna. To cope with this problem, it is possible to insert a noise filter in a load line connecting the fuel pump. However, the insertion of the noise filter involves a problem that the control circuit becomes bulky and heat generated therein becomes high, increasing power consumption.

SUMMARY OF THE INVENTION

The present invention has been made in view of the above-mentioned problem, and an object of the present invention is to provide an improved fuel supply device, in which electromagnetic noises emitted from an in-tank fuel pump are shielded even if a fuel tank is made of a resin material.

The fuel supply device includes a fuel pump for supplying fuel contained in a fuel tank to an internal combustion engine and a sub-tank submerged in the fuel. The fuel pump is disposed in the sub-tank. The sub-tank is made of a metallic material such as stainless steel, and the fuel tank is made of a resin material. The fuel pump is controlled by a control circuit disposed on a cover unit closing an upper opening of the fuel tank. The metallic sub-tank containing the fuel pump therein is grounded to a body of an automotive vehicle thereby to intercept electromagnetic noises generated in switching operation of the fuel pump.

Since the fuel pump is shielded by grounding the metallic sub-tank containing the fuel pump therein, the electromagnetic noises generated in the fuel pump are intercepted, thus eliminating radio noises to a radio receiver mounted on the vehicle. Only the electromagnetic noises emitted from the fuel pump in the downward direction may be shielded instead of shielding the noises directed in all directions. This is because the noises directed in the upward direction are shielded by a metallic floor panel positioned above the fuel tank made of resin. However, the noises emitted in the downward direction have to be intercepted by means of a shielding member such as the grounded metallic sub-tank.

According to the present invention, the electromagnetic noises emitted from the in-tank fuel pump are surely shielded even when the fuel tank is made of resin. Other objects and features of the present invention will become more readily apparent from a better understanding of the preferred embodiment described below with reference to the following drawings.

DETAILED DESCRIPTION OF THE PREFERRED EMBODIMENT

Figure 1:
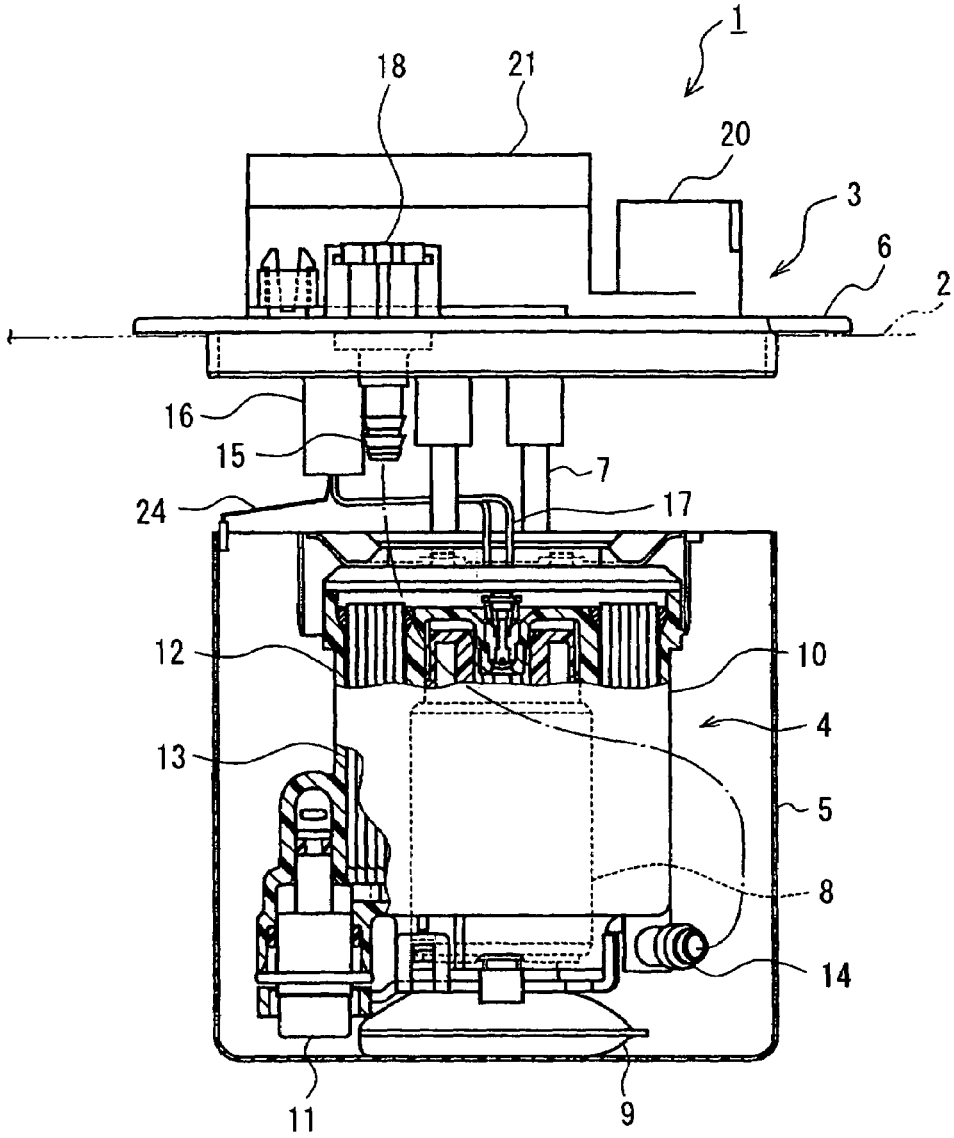
FIG. 1 is a side view (partially cross-sectioned) showing a fuel supply device according to the present invention.
Figure 2:
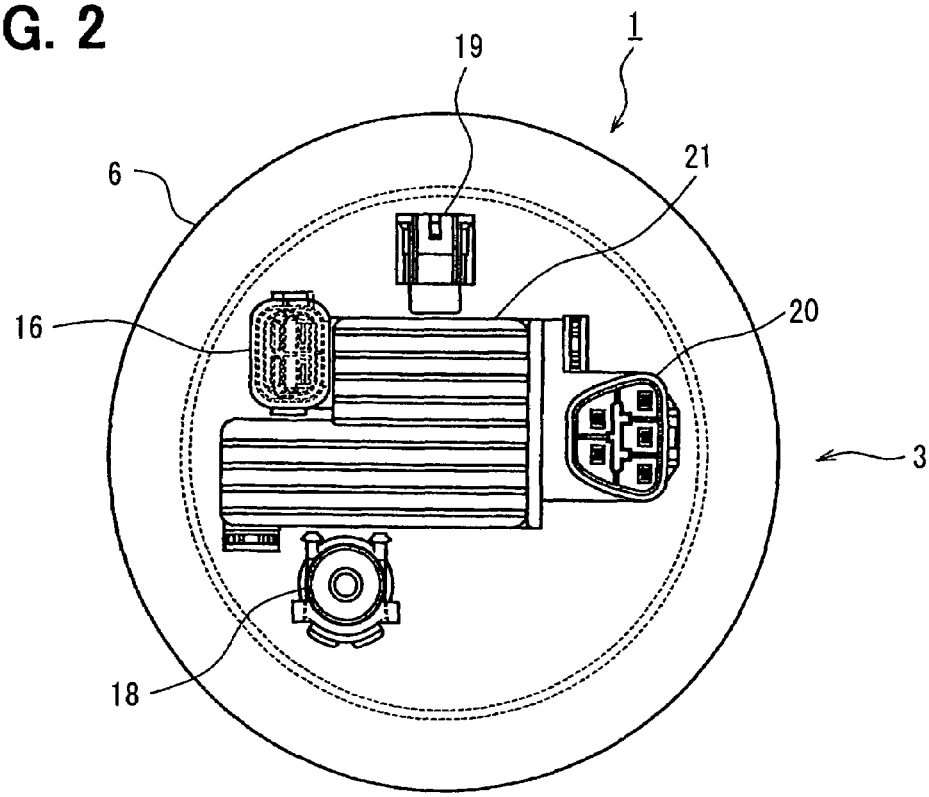
FIG. 2 is a plan view showing the fuel supply device, viewed from an upper side of the device.

A preferred embodiment of the present invention will be described with reference to accompanying drawings. Referring to FIGS. 1 and 2, an entire structure of a fuel supply device 1 of the present invention will be described. The fuel supply device 1 includes a cover unit 3, a sub-tank 5 submerged in fuel contained in a fuel tank 2 and a pump unit 4 disposed in the sub-tank 5. Only an upper surface of the fuel tank 2 is shown in FIG. 1 with a dotted line. The cover unit 3 includes a flange 6 made of a resin material such as POM (polyacetal) that closes an upper opening of the fuel tank 2.

The sub-tank 5 is connected to the flange 6 by a pair of shafts 7 and pushed down resiliently against a bottom wall of the fuel tank via a compression springs (not shown). In this manner, the sub-tank 5 always contacts the bottom wall of the fuel tank 2 even if the fuel tank 2 expands or shrinks according to temperature changes. The pump module 4 is contained in the sub-tank 5. The pump module 4 includes a fuel pump 8, a suction filter 9, a fuel filter 10 and a pressure regulator 11. The suction filter 9 removes foreign particles in fuel contained in the sub-tank and sucked by the fuel pump 8. The fuel filter 10 is composed of a cylindrical filter case 12 and a filter element 13 contained in the filter case 12 to surround an outer periphery of the fuel pump 8. The fuel filter 10 removes foreign particles contained in fuel pumped out from the fuel pump 8.

An outlet port 14 for pumping out fuel filtered by the filter element 13 is provided at a bottom portion of the filter case 12. The outlet port 14 is connected to an inlet port 15 formed on a bottom surface of the cover unit 3 via a pipe having flexible bellows (not shown). A pressure regulator 11 disposed at a bottom portion of the filter case 12 regulates pressure of the fuel pumped out from the outlet port 14. The fuel pressure is regulated by returning excessive fuel into the sub-tank 5.

A direct connector 16 is formed on a bottom surface of the cover unit 3, and the fuel pump 8 is connected to the direct connector 16 via lead wires. On an upper surface of the cover unit 3, an outlet pipe 18 and a fuel gauge connector 19 (refer to FIG. 2) and a connector 20 are formed. A fuel pipe is connected to the outlet pipe 18, and a fuel gauge is connected to the fuel gauge connector 19 via a lead wire. A cable from an engine ECU (Electronic Control Unit) 25, a power supply wire and a grounding wire (not shown) are connected to the connector 20. On an upper surface of the cover unit 3, a casing 21 containing a control circuit 22 (shown in FIG. 3) therein is formed. The control circuit 22 includes a control IC (Integrated Circuit) 23 for supplying power to the fuel pump 8 in a controlled manner.

The sub-tank 5 is made of a metallic material such as stainless steel or steel. A shield-grounding wire 24 is connected to an upper end of the sub-tank 5 by soldering, welding or staking. The shield-grounding wire 24 is connected to a ground line of the control circuit via the direct connector 16.

Figure 3:
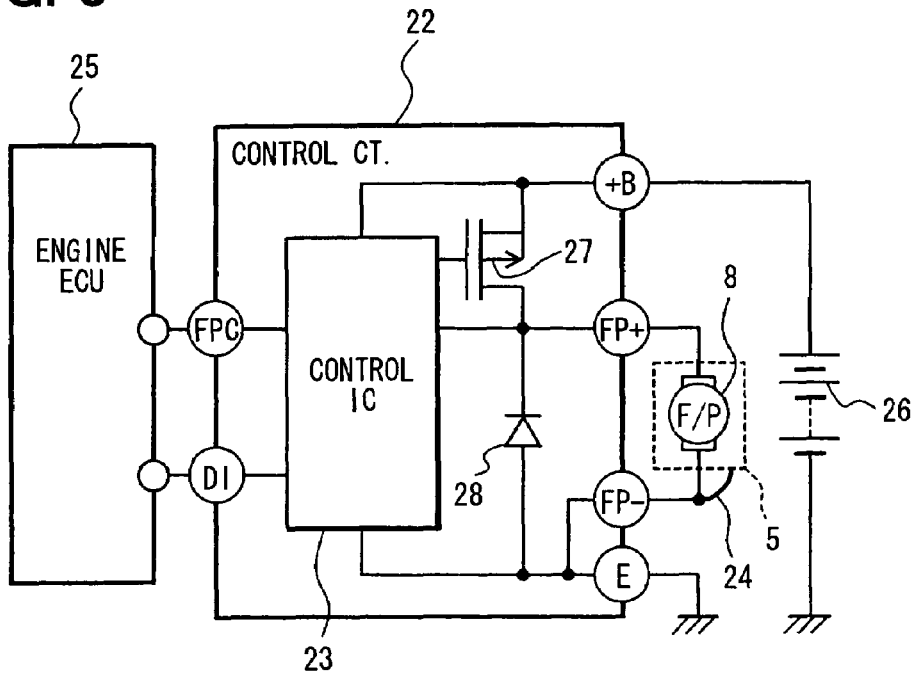
FIG. 3 is a circuit diagram showing electric connections in the fuel supply device.

With reference to FIG. 3, electrical connections in the fuel supply device 1 will be described. Input terminals of the control IC 23 are connected to a control terminal FPC and a diagnosis terminal DI of the control circuit 22. Control signals are inputted from the engine ECU 25 to the control IC 23 through the control terminal FPC. The control IC 23 is diagnosed by the engine ECU 25 through the diagnosis terminal DI.

A power source terminal of the control IC 23 is connected to a power source terminal B+ of the control circuit 22, and the power source terminal B+ is connected to a plus terminal of an on-board battery 26. A ground terminal of the control IC 23 is connected to a ground terminal E of the control circuit 22, and the ground terminal E is grounded to a body of the vehicle. An output terminal of the control IC 23 is connected to a gate of a P-channel power MOS-FET 27 (Metal Oxide Semiconductor—Field Effect Transistor). A source of the power MOS-FET 27 is connected to the power source terminal B+ of the control circuit 22, and a drain of the power MOS-FET 27 is connected to a plus terminal FP+ of the control circuit 22. The FP+ terminal is connected to a plus terminal of the fuel pump 8. A minus terminal of the fuel pump 8 is connected to a minus terminal FP− of the control circuit 22, and the minus terminal FP− is connected to the ground terminal E. A diode 28 is connected between the plus terminal FP+ of the control circuit 22 and the ground terminal E, as shown in FIG. 3. The control IC 23 controls the power MOS-FET 27 in a switching manner and thereby controls power to be supplied to the fuel pump 8 and its rotational speed.

The metallic sub-tank 5 is grounded to the vehicle body by connecting it to the minus terminal FP− of the control circuit 22 through the shield-grounding wire 24. That is, the shield-grounding wire 24 can be made common to the minus terminal FP− by using a high-side switch driving structure in the control circuit 22. It is not necessary to additionally provide a connector for connecting the shield-grounding wire 24.

Since the power MOS-FET 27 is controlled in a switching manner (e.g., under a pulse width modulation control) by the control IC 23, high frequency electromagnetic noises are emitted from the fuel pump 8. In the case where the fuel tank 2 is made of a metallic material, the electromagnetic noises are intercepted by the fuel tank 2. In the case where the fuel tank 2 is made of resin, the electromagnetic noises are emitted through the fuel tank 2. The noises emitted upward from the fuel pump 8 are intercepted by a floor panel of the vehicle since the fuel tank 2 is usually positioned under the floor panel. However, the noises emitted downward from the fuel pump 8 reach the ground through the resin fuel tank 2 unless they are intercepted by an intercepting member. In the embodiment of the present invention, the noises emitted in all directions are intercepted by the grounded metallic sub-tank 5.

The shielding effects are also obtained by forming a shield layer on the bottom wall of a fuel tank 2 made of resin or by forming a shield layer on an outer periphery of a sub-tank 5 made of resin. To evaluate shielding effects attained in various ways, evaluation tests are performed. One type of samples is made in a manner shown in FIG. 4, and another type of samples is made in a manner shown in FIG. 5.

Figure 4:
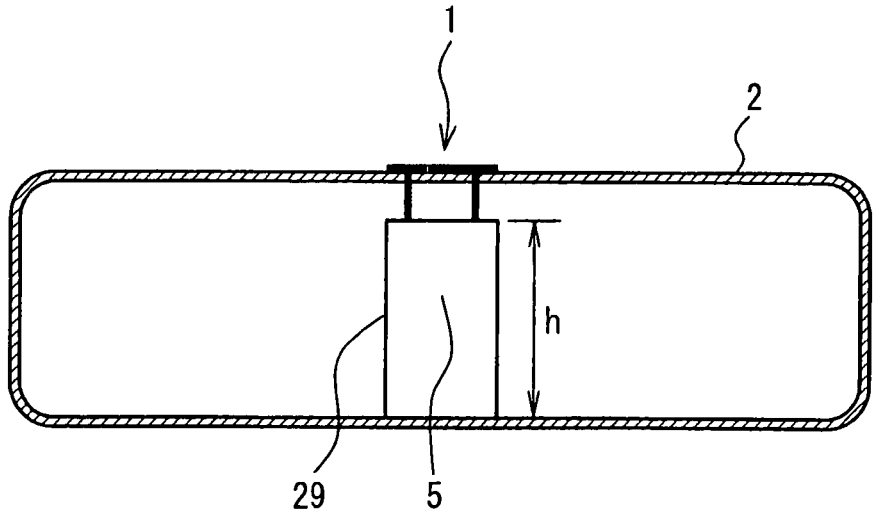
FIG. 4 is a cross-sectional view showing a fuel tank in which a sub-tank having a shield layer is disposed, as a test sample.
Figure 5:
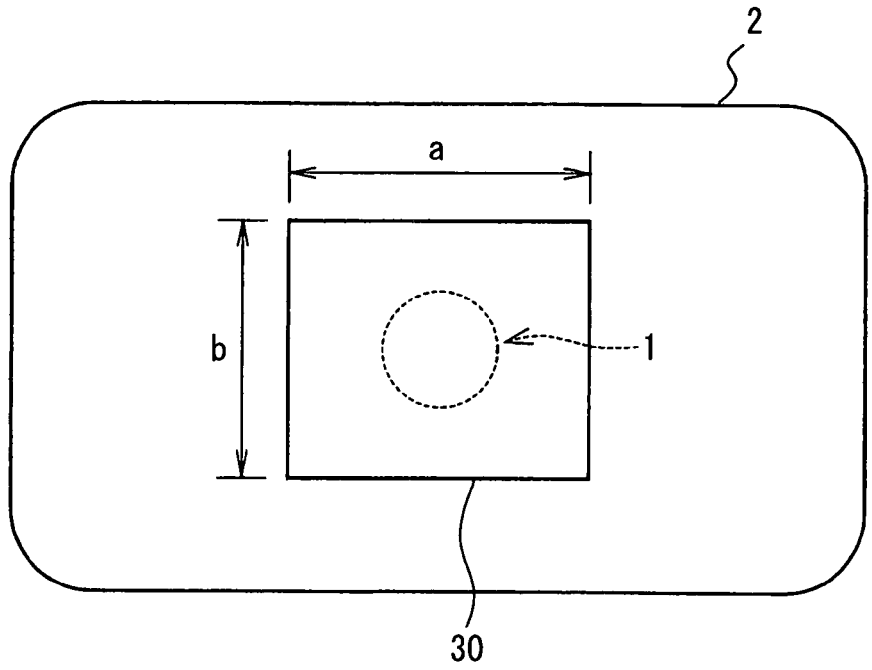
FIG. 5 is a plan view showing an outside surface of a bottom wall of the fuel tank, where a shield layer is formed, as another test sample.

In FIG. 4, a fuel supply device 1 having a resin sub-tank 5 is disposed in a resin fuel tank 2, and an outer periphery of the sub-tank is covered with an aluminum tape, forming a shield layer 29 having a height "h". A sample having a shield layer height h/2 is also made. FIG. 5 shows an outer surface of a bottom wall of a resin fuel tank 2, on which a shield layer 30 is formed. The size of the shield layer a×b is variously changed. In addition, a sample having no shield layer is made. These samples are tested and their shielding effects are evaluated.

Figure 6:
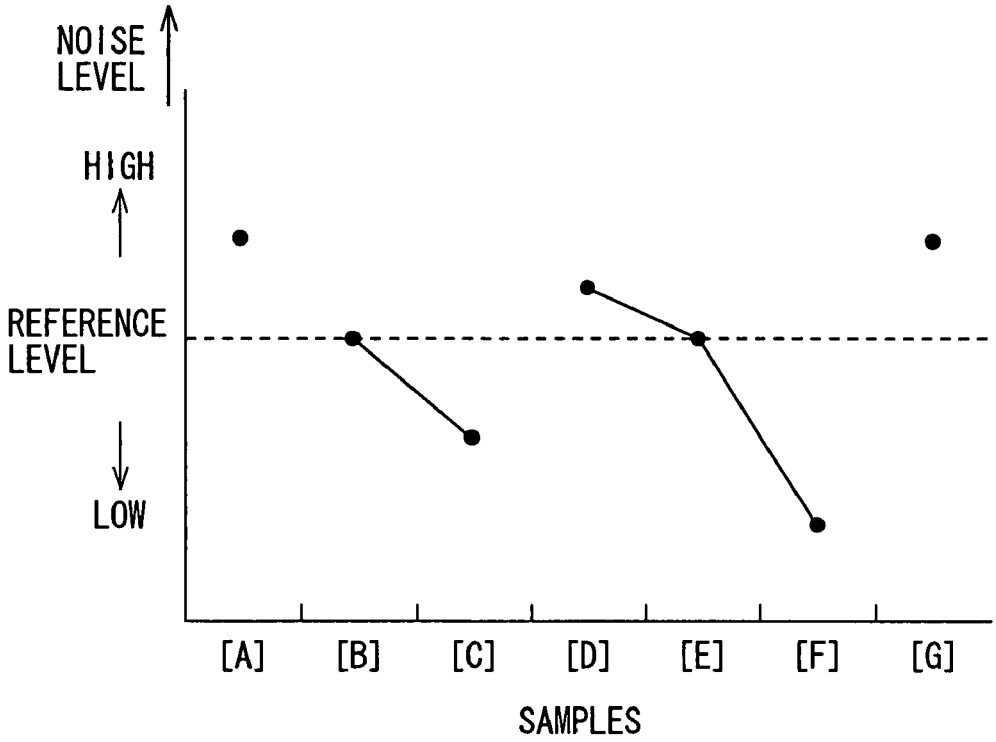
FIG. 6 is a graph showing results of noise level tests for the test samples.

With reference to FIG. 6, the results of the test will be explained. On the abscissa, sample [A] to sample [G] are shown, and on the ordinate, noise levels measured for each sample are shown. Sample [A] is a sample having no shield layer at all; sample [B] is a sample having a shield layer 29 of a height h/2 on the outer periphery of the sub-tank 5; sample [C] is a sample having a shield layer 29 of a height h on the outer periphery of the sub-tank 5; sample [D] is a sample having a shield layer 30 of a size 170×170 mm on the bottom wall of the fuel tank 2; sample [E] is a sample having a shield layer 30 of a size 300×300 mm on the bottom wall of the fuel tank 2; sample [F] is a sample having a shield layer 30 of a size 500×500 mm on the bottom wall of the fuel tank 2; and sample [G] is a sample having a shield layer 29 or 30, but the shield layer is not grounded. The shield layers of the samples [B] through [F] are all grounded to the vehicle body. A reference noise level shown on the ordinate is not an absolute value, but it is a reference level that is obtained in samples [B] and [E].

As seen from FIG. 6, the shielding effects are obtained (noise levels become lower) by providing the shield layer 29 or 30 on either the sub-tank 5 or the fuel tank 2 and by grounding the shield layer. However, no shielding effects are obtained if the shield layer is not grounded as in sample [G]. The shielding effects become higher as the height h of the shield layer 29 or the size of the shield layer 30 becomes larger. It is clear from the test results that the noise levels can be reduced by providing the shield layer and by grounding the same. However, forming the shield layer on the resin sub-tank or on the resin fuel tank and grounding the same require an additional manufacturing cost. It is more cost-effective to provide the shield means according to the present invention than to provide the shield layer as done in the test samples explained above.

Advantages attained in the present invention will be summarized below. Since the sub-tank 5 is made of a metallic material and is grounded to the vehicle body, the radio noises (electromagnetic noises) generated by switching operation of the fuel pump 8 are effectively intercepted even when the fuel tank 2 is made of a resin material. The interception of radio noises can be attained without using a noise filter. Since the sub-tank 5 is grounded to the vehicle body by commonly using the direct connector 16 through which the fuel pump 8 is connected, it is not necessary to use an additional connector for grounding. Further, the noise interception effects can be realized in a cost-effective manner.

The present invention is not limited to the embodiment described above, but it may be variously modified. For example, it is possible to provide shielding effects by coating or covering part of a resin sub-tank or a resin fuel tank with conductive paint or a metallic net. Further, the sub-tank or the fuel tank may be made of a molding material containing metallic filler, or they may be made by inserting a metallic member. Shielding members on both of the sub-tank and the fuel tank may be used in combination. The sub-tank 5 may be grounded to the vehicle body via the metallic shaft 7.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A fuel supply device for an automotive vehicle, comprising:

a fuel pump disposed in a fuel tank for supplying fuel to an internal combustion engine mounted on the automotive vehicle;

means for shielding electromagnetic noises emitted from the fuel pump at least in a downward direction of the automotive vehicle; and a sub-tank for covering at least a bottom portion of the fuel pump, wherein the shielding means is grounded to a body of the automotive vehicle, the shielding means is provided at least on a bottom portion of the sub-tank, and the electromagnetic noises are switching noises generated under a pulse width modulation control of voltage or current supplied to the fuel pump.

2. The fuel supply device as in claim 1, wherein:

the sub-tank is made of a metallic material and serves as the shielding means.

3. The fuel pump is disposed supply device as in claim 1, wherein:

the fuel pump is disposed in a metallic sub-tank serving as the shielding means, and the sub-tank is submerged in fuel contained in the fuel tank.

4. A fuel supply device for an automotive vehicle, comprising:

a fuel pump, which is adapted to supply fuel to an internal combustion engine of on the automotive vehicle; and a metallic shield for shielding electromagnetic noise emitted from the fuel pump at least in a downward direction of the automotive vehicle, wherein the shield is attached to the pump and is located at least beneath the pump, and the shield is grounded to a body of the automotive vehicle, wherein the fuel supply device is a unit adapted to be installed in an opening of a fuel tank of the automotive vehicle;

the fuel supply device has a first end, which is adapted to be located outside of the fuel tank, an a second end which is adapted to be located inside the fuel tank, and the first end is opposite to the second end, the shield is located only at the second end of the fuel supply device, so that the shield is adapted to be located only within the fuel tank, and the electromagnetic noise is switching noise generated under a pulse width modulation control of voltage or current supplied to the fuel pump.

5. The fuel supply device as in claim 4, wherein the shield is a sub-tank, which is made of metallic material, and the pump is located within the sub-tank.

6. The fuel supply device as in claim 5, wherein the sub-tank is adapted to be submerged in fuel contained in the fuel tank.

* * * * *